US005437357A

United States Patent [19]

Ota et al.

[11] Patent Number: 5,437,357

[45] Date of Patent: Aug. 1, 1995

[54] BILL IDENTIFICATION APPARATUS

[75] Inventors: Michihiro Ota, Sakado; Takayuki Kojima, Kawagoe, both of Japan

[73] Assignee: Nippon Conlux Co., Ltd., Tokyo, Japan

[21] Appl. No.: 170,402

[22] Filed: Dec. 20, 1993

[30] Foreign Application Priority Data

Dec. 25, 1992 [JP] Japan ..... 4-358125

[51] Int. Cl.[6] ..... G07F 7/04; G07D 7/00

[52] U.S. Cl. ..... 194/206; 194/207; 382/135; 356/71

[58] Field of Search ..... 194/205, 206, 207; 382/7; 356/71, 394

[56] References Cited

U.S. PATENT DOCUMENTS 5,199,543 4/1993 Kamagami et al. ..... 382/7 X
5,242,041 9/1993 Isobe ..... 194/207
5,301,786 4/1994 Yoshihara ..... 194/207

FOREIGN PATENT DOCUMENTS 0477711 4/1992 European Pat. Off. ..... 194/207
58-9990 2/1983 Japan .
63-26918 6/1988 Japan .
64-5354 1/1989 Japan .
2-148383 6/1990 Japan .

*Primary Examiner*—Margaret A. Focarino
*Assistant Examiner*—Scott L. Lowe
*Attorney, Agent, or Firm*—Koda and Androlia

[57] ABSTRACT

A bill identification apparatus which is hardly subject to decision errors attributable to fluctuations of detected data caused by aging or partial soiling of bills. In identifying a bill, physical properties pi for various positions i on the bill are detected in synchronism with the transportation speed of the bill, a correction value pm for making an average value for an inspection section for the detected data pi equal to an average value for an inspection section for standard pattern values pci is obtained, and the detected data pi are corrected by using the correction value pm, thereby eliminating fluctuations of the data attributable to general deterioration or soiling of the bill or detectors. Also, the authenticity and type of the bill are discriminated by computing a heterogeneity pr on the basis of a statistical synthetic evaluation of the correlation between the standard pattern value pci and the detected data pi for each position i, whereby wrong classification and authentication attributable to partial data errors can be prevented.

9 Claims, 11 Drawing Sheets

BILL IDENTIFICATION APPARATUS

BACKGROUND OF THE INVENTION

1. Field of the Invention

The present invention relates to a bill identification apparatus fop use in an automatic vending machine, exchange machine, game machine, etc.

2. Description of the Related Art

Bill identification apparatuses fop determining the type and authenticity of bills ape conventionally proposed and described in Japanese Patent KOKOKU Publication Nos. 63-26918, 64-5854, fop example. These apparatuses ape designed so that sampling data are obtained by detecting colors and shades on various parts of the bills of magnetic particulates contained in ink on the bills by means of sensors as the bills are transported, and the obtained data ape compared with reference patterns. In these conventional bill identification apparatuses, authentic bill signals for types of bills corresponding to the reference patterns ape outputted only when all the data sampled in individual positions are within their respective tolerances with respect to data fop the reference patterns. Thus, the reliability of the classification and authentication depends solely on deviations between the values of the sampling data and the reference pattern data fop the individual positions. In order to reject false bills securely by means of this conventional system, therefore, the tolerances as criteria must be made considerably small. If the tolerances ape too small, however, authentic bills may possibly be concluded to be false when the values of the detected data are uniformly shifted due to stains all over the circulating bills.

To cope with fluctuations of the detected data attributable to soiling or aging of the bills, shifts of the detected data values due to changes of the ambient temperature, etc., an improved bill identification apparatus is proposed and described in Japanese Patent KOKOKU Publication No. 58-9990. According to this apparatus, detected data are corrected by means of the average of the data sampled in individual positions, and the corrected data are compared with reference patterns. If an authentic bill is partially changed in properties by soiling, in this case, however, it will inevitably be rejected as a false bill. Proposed in Japanese Patent KOKAI Publication No. 2-148383, moreover, is a bill identification apparatus which is arranged so that the relationships between reference data for individual bill types and frequency distributions are previously stored, and operations for decision are performed on the basis of the fuzzy theory. Even though the detected data themselves are subject to fluctuations, this apparatus carries out no corrective operation to maintain conformity between the detected data and frequency distribution data as a control, so that it cannot cope with aging or soiling of the bills or sensors.

Accurate determination of the type and authenticity of the bills requires decision operation using a number of sensors and sampling data. According to the conventional bill identification apparatuses, however, all the sampling data detected during the transportation of the bills are retained collectively until data for the last sampling position is detected to be ready for the execution of a decision process. Accordingly, memory means, such as a RAM, requires a large memory capacity, and an arithmetic unit is loaded heavily.

SUMMARY OF THE INVENTION

The present invention provides a bill identification apparatus which is hardly subject to decision errors attributable to fluctuations of detected data caused by aging or partial soiling of bills, and can smoothly perform decision operation without increasing the memory capacity of memory means or excessively loading an arithmetic unit.

The following is a description of the principle of operation of the present invention.

Fluctuations of detected data pi attributable to deterioration of bills and aging of detecting means equally affect the data pi detected in various detection positions i. Accordingly, scattering of the data caused by the deterioration or aging of the bills and the detecting means can be corrected by preparing modified detected data pm.pi, which is a product of the detected data pi for the detection positions i and a correction value pm. The correction value pm is obtained by dividing the sum total Σpci of standard pattern values pci by an integrated value Σpi of the detected data pi for an entire detection section.

Using a standard deviation psi representing the scattering of the detected values pci for the individual positions i caused when a large number of authentic bills are deposited, the scattering of the modified detected data pm.pi for authenticity decision is given by a deviation phi in the following equation (3).

$$phi=(pm.pi-pci)/psi \tag{3}$$

It is generally known that the deviation phi thus obtained is equivalent to a sample from a population which has a 0-average 1-variance standard normal distribution, and that the sum of the squares of the deviation complies with the $\chi^2$ distribution. Thus, when a heterogeneity pr indicative of the correlation between the respective diagram forms of the modified detected data pm.pi and the authentic standard data pci is defined as the following equation (4), the heterogeneity pr complies with the $\chi^2$ distribution, and the modified detected data pm.pi for each position i is associated with the probability which pertains to the diagram form of the authentic standard data pci.

$$\begin{aligned} pr &= \sum_{i=imin}^{imax} phi^2 \\ &= \Sigma\{(pm \cdot pi - pci)/psi\}^2 \\ &= pm^2 \cdot \Sigma\,(pi/psi)^2 - 2 \cdot pm \cdot \\ &\quad \Sigma(pi \cdot pci/psi^2) + \Sigma(pci/psi)^2. \end{aligned} \tag{4}$$

Whether or not the diagram form indicated by the modified detected data pm.pi, compared with that of the standard data pci, has a portion which projects beyond a practical range of the normal distribution, that is, whether or not a bill as an object of decision is authentic, can be determined depending on whether or not the heterogeneity pr, obtained by executing the computation of equation (4), is within a predetermined range.

Moreover, the general soiling and deterioration of the detecting means and the bill are substantially homogeneous. In a bill identification apparatus which comprises a plurality of detecting means, therefore, the respective values of correction factors pmj of the individual detecting means should be substantially equal to one another. Thus, even though the correction factors pmj of the individual detecting means are within their tolerances, the general soiling of the bill cannot be regarded as uniform if the correction factors are subject to remarkable scattering. In this case, discriminating means outputs no authentic bill signal.

According to a first aspect of the present invention, there is provided a bill identification apparatus which comprises: transportation means for transporting bills along a transportation path; detecting means in the transportation path for sampling the bills in synchronism with the bill transportation speed, detecting the physical properties of the bills in each of detection positions i, and outputting detected data pi for the detected properties; memory means for storing standard pattern values pci, indicative of average values for the individual detection positions i computed in accordance with the detected data pi obtained by sampling a number of authentic bills by the detecting means, and standard deviation values psi indicative of the degrees of scattering of data in the detection positions i; correction value computing means for obtaining a correction value pm for making an average value for a detection section for the detected data pi, detected by sampling the bills to be identified by the detecting means, equal to an average value fop a detection section for the standard pattern value pci; heterogeneity computing means for obtaining a heterogeneity pr by correcting the detected data pi, detected by sampling the bills to be identified by the detecting means using the correction value pm, subtracting the corresponding standard pattern value pci from thus corrected detected data pi, and integrating the square of the resulting remainder divided by the corresponding deviation value psi, for a detection frequency corresponding to the detection section; and discriminating means for concluding that the bills transported thereto are authentic only when the correction value and the heterogeneity are within the respective tolerances thereof.

According to a second aspect of the present invention, the memory means further stores the sum total $\Sigma pci$ of the standard pattern values pci for the detection section and the sum total $\Sigma(pci/psi)^2$ of the square of each standard pattern value pci divided by each corresponding standard deviation value psi for the detection section; the correction value computing means successively integrates the detected data pi delivered from the detecting means in the detection section, and obtains the correction value pm by dividing the sum total $\Sigma pci$ of the standard pattern values pci by the resulting integrated value $\Sigma pi$ when the detection section terminates; and the heterogeneity computing means successively obtains an integral $\Sigma(pi/psi)^2$ of the square of the detected data pi divided by the deviation value psi in the corresponding position and an integral $\Sigma(pi.pci/psi^2)$ of a value obtained by dividing the product of the detected data pi and the corresponding standard pattern value pci by the square of the deviation value psi, and obtains the heterogeneity pr by making a computation given by the foregoing equation (4) when the detection section terminates. In the data detection, the data required for the computation of the heterogeneity pr are obtained by integrative processing and stored in succession, so that the necessary memory capacity for the retention of the detected data can be saved, the load required for the arithmetic processing of the heterogeneity computing means can be reduced, and the time for the computation of the heterogeneity can be shortened.

According to a third aspect of the present invention, the detecting means comprises a plurality of detecting means Pj arranged in an offset manner in a direction perpendicular to the direction of transportation of the bills; the memory means stores average values, standard pattern values pcij, and deviation values psij for the individual detecting means Pj; the correction value computing means and the heterogeneity computing means obtain correction values pmj and heterogeneities prj, respectively, for the individual detecting means Pj; and the discriminating means concludes that the bills transported thereto are authentic only when all the correction values and the heterogeneities are within the respective tolerances thereof.

According to a fourth aspect of the present invention, moreover, the memory means stores sum total $\Sigma(pcij/psij)^2$ of the square of each standard pattern value pcij divided by each corresponding standard deviation value psij for the detection section; the correction value computing means and the heterogeneity computing means obtain correction values pmj and heterogeneities prj, respectively, for the individual detecting means Pj; and the discriminating means concludes that the bills transported thereto are authentic only when all the correction values and the heterogeneities are within the respective tolerances thereof.

According to a fifth aspect of the present invention, the bill identification apparatus further comprises correction value scattering detecting means for detecting the degrees of scattering of the correction values pmj of the individual detecting means Pj, and the discriminating means concludes that the bills are authentic only when all the correction values, heterogeneities, and scattering degrees are within the respective tolerances thereof. With this arrangement, the authenticity of the bills can be judged by determining whether or not the computed correction values serve to correct the scattering of the data attributable to general soiling or deterioration of the bills.

According to a sixth aspect of the present invention, the bill identification apparatus further comprises overall heterogeneity computing means for obtaining an overall heterogeneity $\Sigma prj$ by summing up the heterogeneities prj for the individual detecting means Pj, and the discriminating means does not conclude that the bills are authentic when the overall heterogeneity $\Sigma prj$ is not within the tolerance thereof. Thus, the authenticity of the bills can be determined exactly on the basis of synthetic evaluation by means of the individual detecting means.

Furthermore, the memory means stores each data corresponding to the type of the bills, the correction value computing means, the heterogeneity computing means, and the overall heterogeneity computing means obtain the correction value, heterogeneity, and overall heterogeneity, respectively, for each bill type, and the discriminating means outputs authentic bill signals corresponding to the bills of types such that the correction value, heterogeneity, and overall heterogeneity are all within the respective tolerances thereof, and that the overall heterogeneity $\Sigma prj$ has a minimum value. In this case, the discriminating means outputs the authentic bill signals corresponding to the bill types in consideration of the degree of scattering of the correction value obtained by the correction value scattering detecting means.

DETAILED DESCRIPTION OF THE PREFERRED EMBODIMENT

Figure 1:
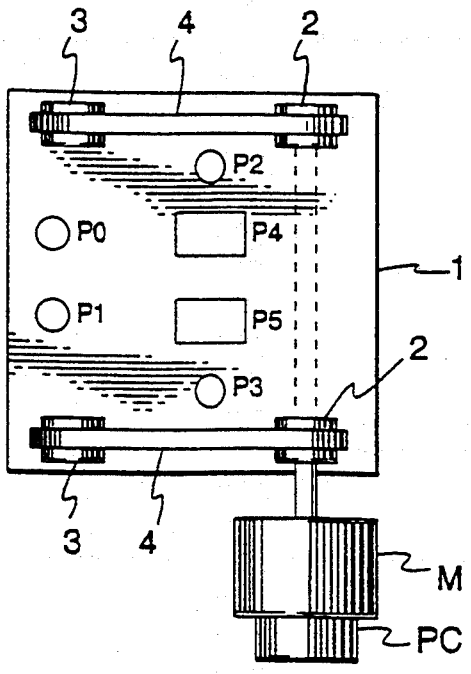
FIG. 1 is a plan view showing the principal part of a bill identification apparatus according to one embodiment of the present invention.

Referring to FIG. 1, there are shown two sets of belt conveyor means arranged on either side of a plate 1 which forms a bill transportation path. Each belt conveyor means comprises a driving timing pulley 2, a driven timing pulley 3, and a timing belt 4 passed around these pulleys. An inserted bill is transported by means of the driving timing pulleys 2 on both sides driven by a motor M. Symbol PC designates a pulse coder for outputting a rotation detection signal with every predetermined number of revolutions of the motor M. Symbols P0 to P3 designate transmission-type optical sensors which are each formed of a light emitting element and a photoelectric transducer disposed on either side of a bill transportation path on the plate 1. The sensors P0 to P3 output electrical signals corresponding to the volume of light transmitted through the inserted bill. Magnetic sensors P4 and P5 detect magnetic particulates contained in ink on the bill and outputting electrical signals. The bill is inserted and transported from left to right of FIG. 1.

Figure 2:
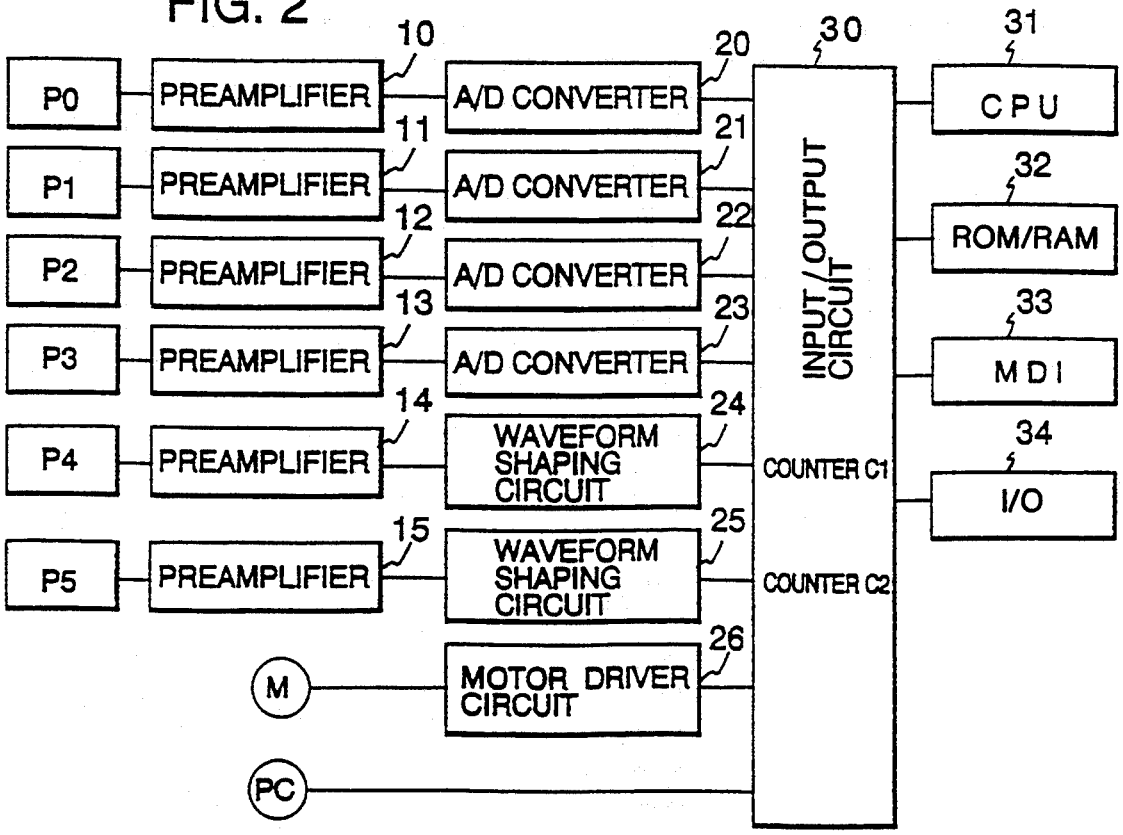
FIG. 2 is a block diagram showing an outline of a control section of the bill identification apparatus shown in FIG. 1.

As shown in FIG. 2, the respective photoelectric transducers of the sensors P0 to P3 are connected, through their corresponding preamplifiers 10 to 13 and A/D converters 20 to 23, to an input/output circuit 30 which is connected to a CPU 31. The output signals (see FIG. 4*a*) from the sensors P0 to P3 are amplified by means of the preamplifiers 10 to 13, respectively, converted into digital signals (see FIG. 4*b*), and applied to predetermined input ports of the input/output circuit 30. Further, the sensors P4 and P5 are connected to the input/output circuit 30 through their corresponding preamplifiers 14 and 15 and waveform shaping circuits 24 and 25. The signals from the sensors P4 and P5 are amplified by means of the preamplifiers 14 and 15, respectively (see FIG. 4*d*), digitized by means of the waveform shaping circuits 24 and 25, respectively (see FIG. 4*e*), and applied to the input/output circuit 30. Every time a shaped waveform is applied to the input/output circuit 30, values in counters C1 and C2 in the circuit 30 are counted up automatically (see FIG. 4*f*). In response to a reset signal from the CPU 31, moreover, the counters C1 and C2 are reset automatically. The reset cycle of the counters C1 and C2 is equal to the output cycle of the rotation detection signal from the pulse coder PC.

A memory 32, which comprises a RAM and a nonvolatile ROM, stores in a nonvolatile manner control programs associated with the sequence operation of a bill identification apparatus, decision on bills, etc. and various set data necessary for the decision on bills and the like. The set data for decision can be freely reloaded by operation through a manual data input device 33. The motor M, as the drive source for the belt conveyor means, is operatively controlled by the CPU 31 through a motor driver circuit 26 and the input/output circuit 30. The rotation detection signals from the pulse coder PC are applied to the CPU 31 via the input/output circuit 30. An input/output interface 34 is used for the input and output of signals between the bill identification apparatus and an automatic vending machine, game machine, or the like which incorporates the identification apparatus.

According to the present embodiment, when the leading end of a bill is inserted between the light emitting elements and photoelectric transducers of the sensors P0 and P1, the light volume detected by the sensors P0 and P1 is reduced. As the detection signals from the sensors P0 and P1 are reduced, the CPU 31 concludes that the bill is inserted, and rotates the motor M forwardly, thereby starting to receive the inserted bill. In synchronism with the rotation detection signal which is delivered from the pulse coder PC with every predetermined number of revolutions of the motor M, the light transmission factor for a specific position on the inserted bill and the presence of the magnetic particulates therein are detected by means of the sensors P0 to P5.

Figure 3:
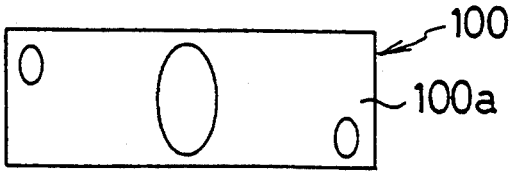
FIG. 3 is a view illustrating a bill as an object of decision.
Figure 4A:
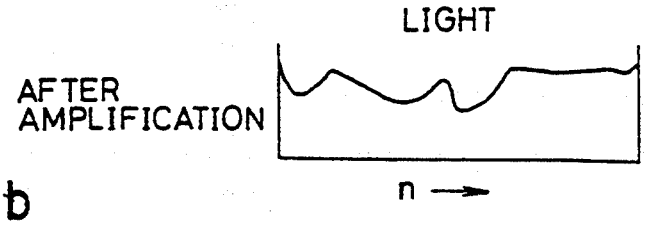
FIGS. 4*a* to 4*g* are diagrams showing transitions of data processing indicative of the physical properties of bills detected by means of sensors of the bill identification apparatus.
Figure 4B:
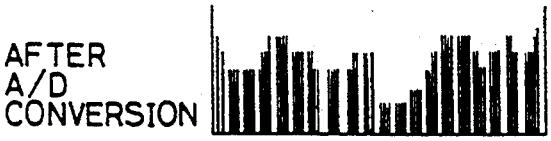

FIG. 4*a* is a diagram showing the transition (change of light transmission factor) of the electrical signal delivered from the sensor P0 when a leading end 100*a* of a bill 100, such as the one shown in FIG. 3, is inserted into the bill identification apparatus, with respect to an integrated value n (specific position on the inserted bill) of the frequency of delivery of the rotation detection signals from the pulse coder PC. In the present embodiment, the bill is inserted from left to right of FIG. 1, so that a light transmission factor for the leading-end side of the bill 100 shown in FIG. 3 corresponds to the left-hand end (with a smaller value for n) of the diagram of FIG. 4*a*, and a transmission factor for the trailing-end side of the bill to the right-hand end (with a larger value for n) of FIG. 4*a*. The distance between the respective positions on the bill in which the light transmission factors detected by the sensor P0 are read corresponds to the number of revolutions of the motor M which is equivalent to the transportation pitch for the bill. Moreover, the position for a first data read cycle is determined depending on the insertion detection timings for the sensors P0 and P1 which function as bill insertion sensors. The authenticity and type of the inserted bill can be determined by previously storing a diagram form as an array (n, pcn) indicative of the relationship between values n for the integrated pulse number and detected values pcn, obtained when an authentic bill is inserted. In the conventional bill identification apparatuses, therefore, the average of the values pcn corresponding to the individual values n is obtained by depositing a large number of authentic bills, and the average value, along with a tolerance , is previously stored as a criterion. Thereafter, the authenticity and type of each deposited bill are determined depending on whether or not all of detected values si associated with data (n, sn) detected from each bill are between pcn+ (upper limit value) and pcn−s (lower limit value).

Figure 5:
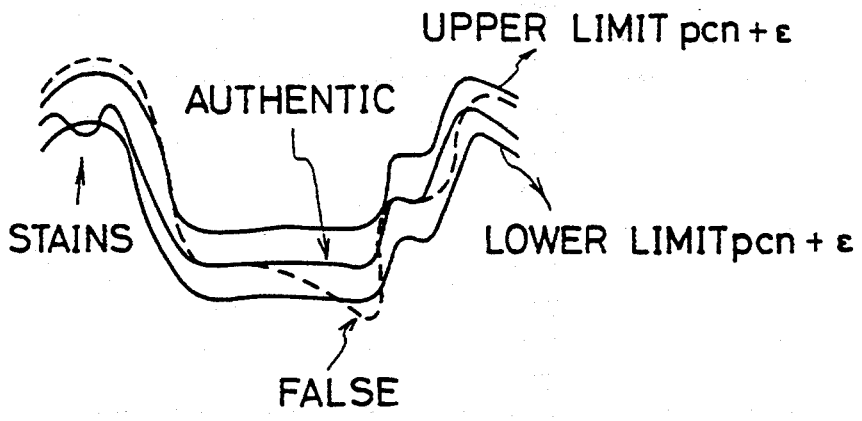
FIG. 5 is a diagram showing a case in which upper and lower limit values are set as criteria for a decision process.

In order to reject false bills securely by this conventional system, the difference between the upper and lower limit values as criteria must be set at a considerably small value, as shown in FIG. 5, for example. If the tolerance is too small, however, those authentic bills which cannot satisfy some of authenticity conditions due to partial soiling or the like may be rejected in some cases. Also, those authentic bills which are entirely soiled by long circulation so that their detected data values are uniformly shifted up or down may possibly be concluded to be false.

According to the present embodiment, therefore, the following processes are executed in order to prevent wrong decisions which are attributable to partial soiling of the bills, fluctuations of optical data caused by aging of the optical sensors or deterioration of the bills, etc.

The following is a description of the way of preventing wrong decisions attributable to aging of the optical sensors, deterioration of the bills, etc. Variations of the detected light volume attributable to aging of the optical sensors act uniformly on various parts of each bill. Also, stains on the bill attributable to long use can be supposed to be produced substantially uniformly on various parts of the bill. Accordingly, an appropriate decision of authenticity can be made by shifting a diagram form based on the data (n, sn) detected from the deposited bill for authenticity decision in a certain proportion in the vertical direction of FIGS. 4*a* and 5, thereby correcting the diagram form so that it is coincident with the diagram form of the average data array (n, pcn) for each value n obtained when an authentic bill is inserted. A correction factor pm as this correction value is given according to the following equation (1).

$$pm = \sum_{n=nmin}^{nmax} pcn/\Sigma sn. \tag{1}$$

Thus, an appropriate discrimination process can be executed by comparing authentic standard data pci with a modified value pm.sn which is the product of the detected data sn detected from each position n for authenticity decision and the correction factor pm.

In synchronism with the rotation detection signals from the pulse coder PC, the light transmission factor for the specific position on the inserted bill and the presence of the magnetic particulates are detected by means of the sensors P0 to P5. In the present embodiment, a bill inspection section is divided into a plurality of subsections so that data obtained between the subsections are leveled to be detected data for each position (section), without using the data from the sensors P0 to P5 directly as data for the position. The deposition of the bill as an object of identification is completed as the rotation detection signals from the pulse coder PC are inputted for nmax number of pulses after the drive of the motor M is started for transportation. In the present embodiment, a data detection region on the bill is divided into sections corresponding individually to movements for which the rotation detection signals from the pulse coder PC are inputted for pdev number of pulses. Then, the transmission data and magnetic data are leveled for each section to compute detected data pi for each position (section). The aforesaid process is executed by comparing the detected data for each section and standard data (stored in the nonvolatile RAM of the memory 32) for each section obtained by testing a large number of authentic bills. The following description is based on conditions nmax=259 and pdev=8.

Thus, according to the present embodiment, the correction factor pm is given by the following equation (2), and modified detected data for each detected data pi is represented by pm.pi.

$$pm = \sum_{i=imin}^{imax} pci/\Sigma pi. \tag{2}$$

Using a standard deviation psi indicative of scattering of the detected values pci for the individual positions i caused when a large number of authentic bills are deposited, the scattering of the modified detected data pm.pi for authenticity decision is given by a deviation phi in the following equation (3).

$$phi=(pm.pi-pci)/psi \tag{3}$$

It is generally known that the deviation phi thus obtained is equivalent to a sample from a population which has a 0-average 1-variance standard normal distribution, and that the sum of the squares of the deviation complies with the $\chi^2$ distribution. Thus, by defining heterogeneity pr indicative of the correlation between the respective diagram forms of the modified detected data pm.pi and the authentic standard data pci according to the following equation (4), the heterogeneity pr complies with the $\chi^2$ distribution, and the value of modified detected data pm.pi for each position i pertains to the probability associated with the diagram form of the authentic standard data pci.

$$\begin{aligned} pr &= \sum_{i=imin}^{imax} phi^2 \\ &= \Sigma\{(pm \cdot pi - pci)/psi\}^2 \\ &= pm^2 \cdot \Sigma\,(pi/psi)^2 - 2 \cdot pm \cdot \\ &\quad \Sigma(pi \cdot pci/psi^2) + \Sigma(pci/psi)^2 \end{aligned} \tag{4}$$

Thus, whether or not the diagram form of the corrected detected data pm.pi, compared with that of the standard data pci, has a portion which projects beyond a practical range of the normal distribution can be determined depending on whether or not the heterogeneity pr given by equation (4) is within a predetermined range.

Since the variations of the detected light volume attributable to aging of the optical sensors and general soiling or deterioration of the bills are substantially homogeneous, the respective values of correction factors pmj of the individual optical sensors Pj should be substantially equal to one another when an authentic bill is inserted. Thus, even though the correction factors pmj of the individual sensors are within their tolerances, the general soiling of the bill cannot be regarded as uniform if the correction factors pmj of the individual sensors are subject to remarkable scattering. The scattering of the correction factors pmj of the individual sensors also constitutes an essential factor for the authenticity decision. This scattering of the correction factors may be determined on the basis of the difference between the maximum and minimum values of the correction factors of the sensors, for example. According to the present invention, however, the scattering is estimated from the average of the correction factors and the standard deviation between the correction factors obtained when a number of authentic bills are inserted, as in the case based on equation (3). In the present embodiment, possible values for the correction factors pmj of the sensors Pj range from 0 to positive infinity, centering around 1, so that this distribution is transformed into a normal distribution covering values which range from negative infinity to positive infinity, centering around 0. First, the correction factors pmj of the individual sensors Pj are transformed into standardized correction factors zpmj according to the following equation (5), using standard deviations pmsj for the correction factors of the sensors Pj obtained when a number of authentic bills are inserted.

$$zpmj=(LOG\ pmj)/pmsj \tag{5}$$

Then, a value pmss indicative of scattering of the correction factor distribution for the sensors Pj is computed according to the following equation (6).

$$pmss=\left[\sqrt{\left[\sum_{j=0}^{jmax} zpmj-\{(\Sigma zpmj)/(jmax+1)\}\right]^2/jmax-pmcx}\right]/pmsx \tag{6}$$

$$=\left[\sqrt{\left[\sum_{j=0}^{jmax} zpmj^2-\{(\Sigma zpmj)^2/(jmax+1)\}\right]/jmax-pmcx}\right]/pmsx,$$

where pmcx and pmsx are the average of the correction factors of the sensors Pj and the standard deviation of the correction factors, respectively, obtained when a number of authentic bills are tested.

The root-signed term of equation (6) represents the correction factor deviation for each sensor for the subject bill. By comparing the value pmss, indicative of the scattering of the correction factor deviations for the individual sensors Pj, with a reference value, it is determined whether the correction factors pmj of the sensors are computed in order to correct the scattering of the detected data attributable to aging of the sensors or general soiling of the bill, or the correction factors pmj are subject to scattering because the deviation of the light transmission factor is partially different or because a false bill with a wrong magnetic particulate density is deposited.

As mentioned before, the scattering of the correction factor deviations for the sensors may be determined depending on whether or not the difference between the maximum and minimum values of the correction factors pmj is within its tolerance.

Figure 6:
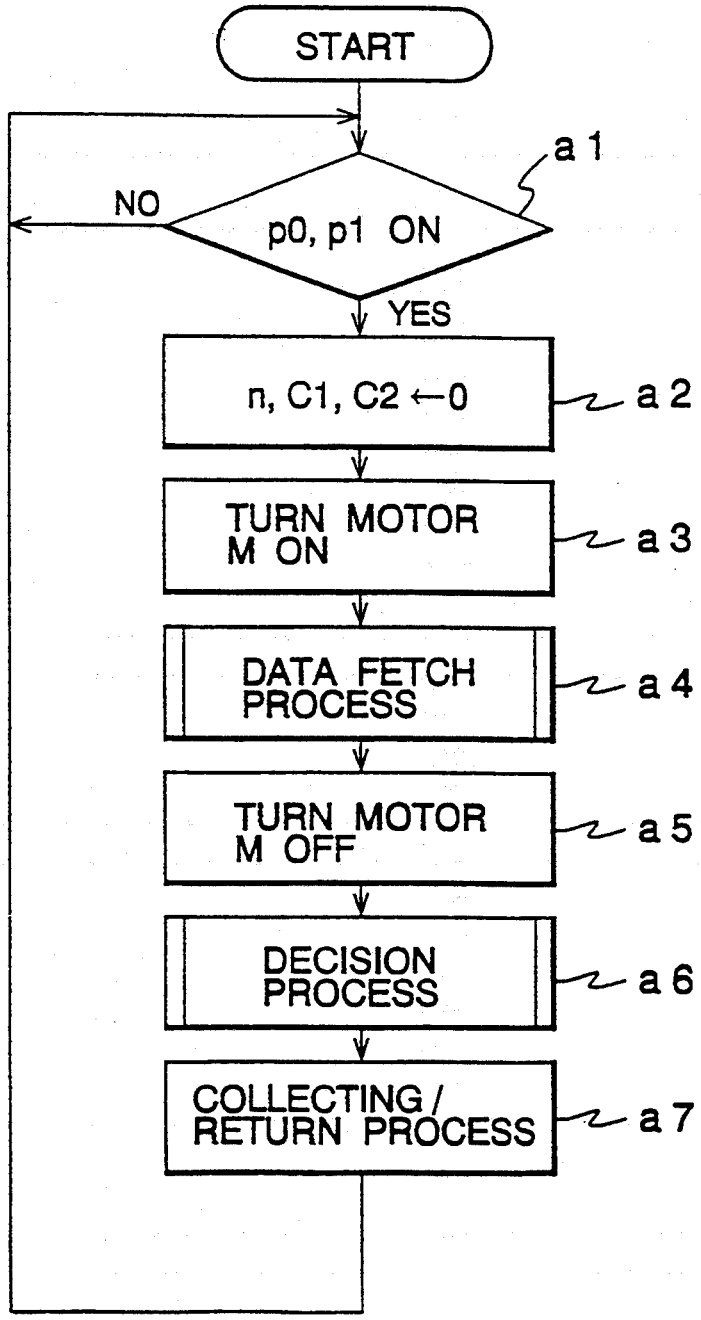
FIG. 6 is a flow chart showing an outline of processing operations that the bill identification apparatus of the invention executes.

FIG. 6 is a flow chart showing an outline of operation for the aforementioned processes executed by the CPU 31 for operatively controlling the bill identification apparatus according to the present embodiment. FIGS. 7 to 13 are flow chart schematically showing the principal parts of the processing operation. Referring now to these flow charts, the processing operation according to the present embodiment will be described.

When the light volumes detected by means of the sensors P0 and P1, which function as bill insertion sensors, are reduced in Step a1, the CPU 31 concludes that a bill is inserted, and then proceeds to Step a2. In Step a2, the CPU 31 initializes a counter n for integrating the rotation detection signals from the pulse coder PC, various temporary-storage registers in the memory 32, and the counters C1 and C2 in the input/output circuit 30. Then, in Step a3, the CPU 31 causes the motor M to rotate forwardly, thereby starting the operation of the timing belt 4 for transportation. Thereupon, the motor M rotates to transport a predetermined number of inserted bills, the CPU 31 receives every rotation detection signal from the pulse coder PC as an interruption signal, and executes a data fetch process of Step a4, the principal part of which is shown in FIG. 7.

When the data fetch process is started, the CPU 31 first determines, in Step b1, whether or not a value in the counter n for integrating the rotation detection signals from the pulse coder PC is greater than the set maximum value nmax, which is indicative of the number of pulses for the completion of the deposition of the bills. As mentioned before, the value nmax is set corresponding to the number of pulses of the rotation detection signals delivered from the pulse coder PC during the time interval between the start of the forward rotation of the motor M and the completion of the deposition of the inserted bills. In the present embodiment, nmax=259 is given. If the value in the counter n is not greater than the set maximum value nmax, the CPU 31 proceeds to Step b2, whereupon it initializes a sensor selection index j at 0, and determines, in Step b3, whether or not the value of the index j is greater than a maximum value jmax corresponding to the number of sensors. In the present embodiment, jmax=5 is given to indicate the use of the six sensors P0 to P5. If the value of the index j is not greater than the maximum value jmax, the CPU 31 proceeds to Step b4, whereupon it divides the current value in the counter n by the set value pdev, which is indicative of the number of pulses corresponding to one section of the data detection region, and makes the resulting value integral by omitting its decimal fractions (this process is represented by n÷pdev in FIG. 7), thereby obtaining the value i corresponding to the section name of the data detection region. Since pdev=8 is given in the present embodiment, the section name i is set to 0 with n=0 to 7 and i is set to 1 with n=8 to 15.

Subsequently, in Step b5, the CPU 31 selects an input port of the input/output circuit 30 in accordance with the value of the sensor selection index j, and reads current output values px(j) in the A/D converter 20, 21, 22 or 23 for one of the sensors Pj or a current integrated value px(j) in the counter C1 or C2. The objects of reading which correspond to values j=0, 1, 2, 3, 4 and 5 for the selection index j are the A/D converters 20, 21, 22 and 23 and the counters C1 and C2, respectively. If the object of reading is a counter, a reset signal is delivered to this counter when the reading is completed. After reading the output value or integrated value px(j), the CPU 31 proceeds to Step b6, whereupon it integratively stores one of array registers p(i, j) corresponding to the section name i or sensor name j with the value px(j) obtained in Step b5. Then, the CPU 31 increments the value of the index j in Step b7. Thereafter, the CPU 31 repeatedly executes the processes of Steps b3 to b7 in the same manner as described until the value of the index j exceeds the set maximum value jmax corresponding to the number of sensors, and detects and integratively stores data for the individual sensors Pj. The array registers p(i, j) are initialized in the aforementioned process of Step a2, and their initial values are all 0. In these processes, the array registers p(i, j) for j=0 to 5 are integratively stored with detected light reception values (array registers for j=0 to 3) of the optical sensors obtained when the rotation detection signals from the pulse coder PC are detected or the number of magnetic particulates (array registers for j=4 and 5) detected in the period from the time when the preceding rotation signals is detected to the time when the present rotation signal is detected.

Figure 7:
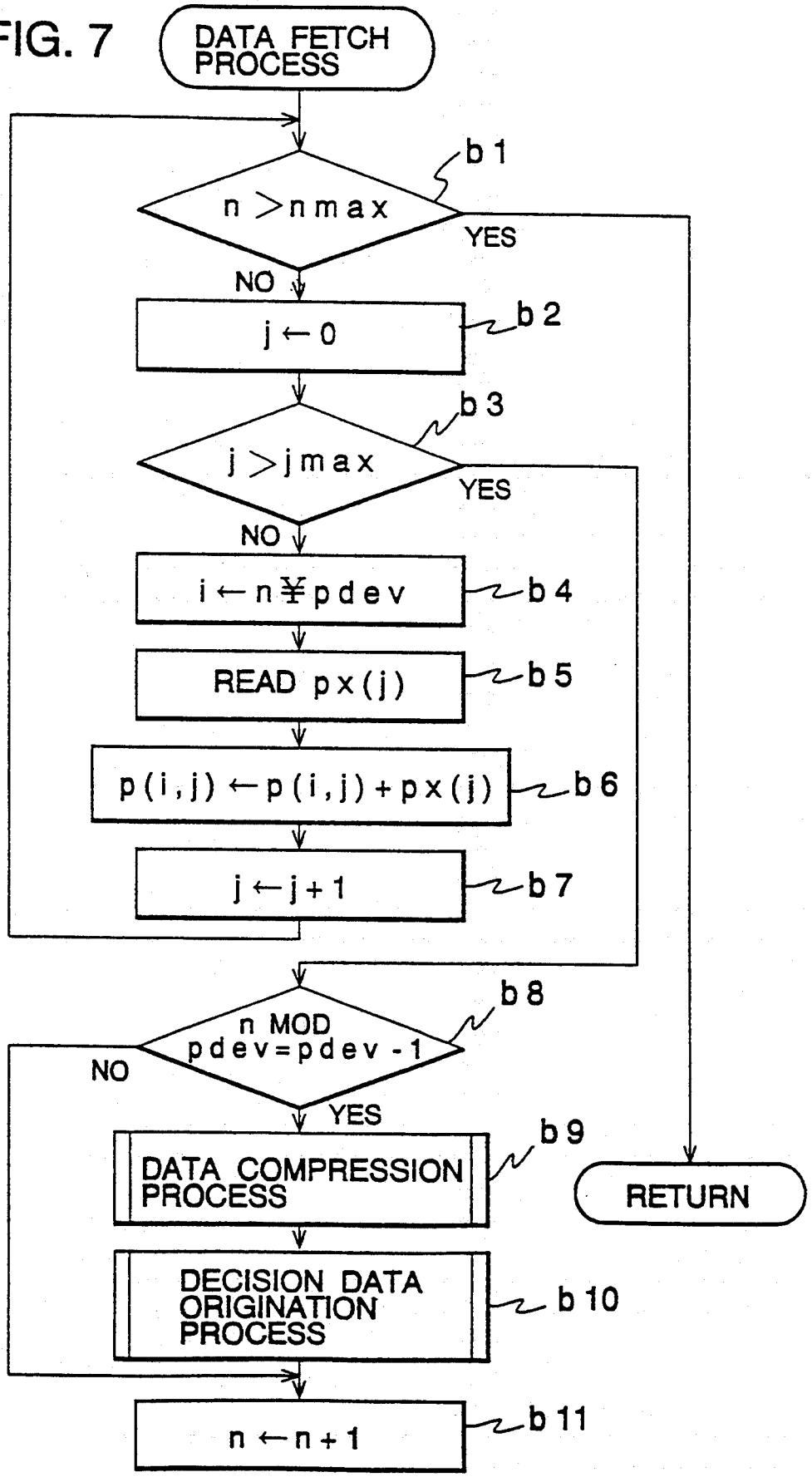
FIG. 7 is a flow chart showing a data fetch process.

When the CPU 31 confirms that the value of the sensor selection index j is greater than the set maximum value jmax and that the addition of the detected data for the individual sensors Pj is completed, it divides the current value in the counter n by the set value pdev, which is indicative of the number of pulses corresponding to one section of the data detection region, and obtains the remaining integer (this process is represented by n MOD pdev in FIG. 7). Then, the CPU 31 determines whether or not the remaining integer is equal to pdev−1, that is, whether or not the data detection timing for the present cycle is one for the final or pdev'th cycle in the data detection region for the one section (Step b8). Since pdev=8 is given in the present embodiment, the remaining integer ranges from 0 to 7 when the value in the counter n is divided by pdev=8, and the remaining integer of 7 (=pdev−1) represents the last cycle for the one section of the data detection region.

If the remaining integer obtained by dividing the current value in the counter n by the set value pdev is not equal to pdev−1, the CPU 31 increments the value in the counter n, and suspends the data fetch process (Step b11). Every time the rotation detection signal from the pulse coder PC is inputted, thereafter, the CPU 31 repeatedly executes the processes of Steps b1 and b2, loop processes of Steps b3 to b7, and processes of Steps b8 and b11 in the same manner as described until the value in the counter n exceeds the set maximum value nmax, or the discrimination condition of Step b8 is satisfied. Before the remaining integer obtained by dividing the current value in the counter n by the set value pdev becomes equal to pdev−1 so that the decision in Step b8 is positive, the integral value i obtained by dividing the current value in the counter n by the set value pdev in the process of Step b4 cannot be updated. Thus, the value for the section name i once computed is maintained until the processes of Steps b1 and b2, loop processes of Steps b3 to b7, and processes of Steps b8 and b11 are successively executed pdev number of times. Also, the values px(j) detected with the pdev number of detection timings corresponding to each section of the data detection region are integrated and stored individually in (jmax+1) number of array registers p(i, j), which have the same section name i and different sensor names j. Then, the processes of Steps b1 and b2, loop processes of Steps b3 to b7, and processes of Steps b8 and b11 are successively executed pdev number of times. Every time the remaining integer obtained by dividing the current value in the counter n by the set value pdev becomes equal to pdev−1 so that the decision in Step b8 is positive, the CPU 31 executes a data compression process (Step b9) and a decision data origination process (Step b10) corresponding to the section name i.

Figure 8:
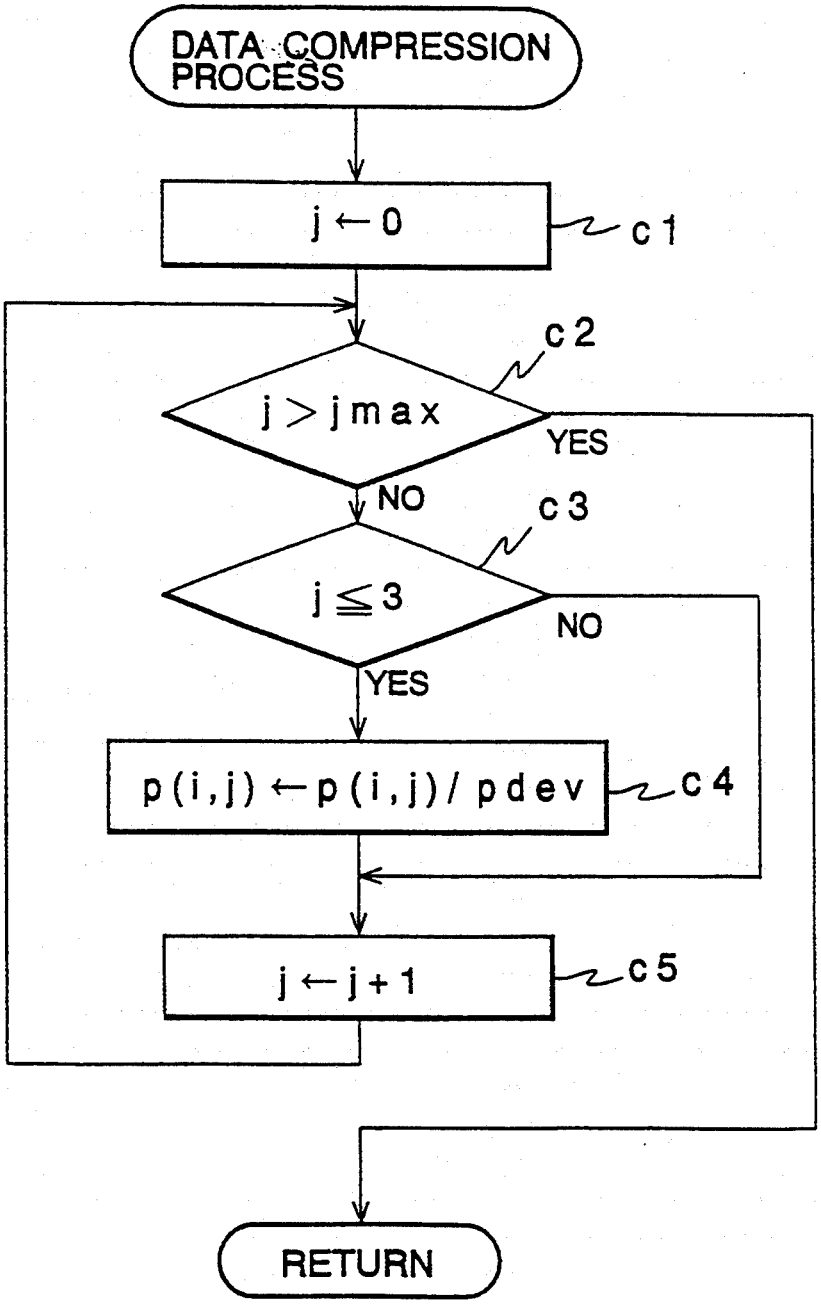
FIG. 8 is a flow chart showing a data compression process.

If it is concluded in the discrimination process of Step b8 that the data fetch process is continuously repeated pdev number of times, the CPU 31 first executes the data compression process of Step b9, the principal part of which is shown in FIG. 8, in order to level the optical data and magnetic data with every section i and compute the detected data for each section i.

Figure 4C:
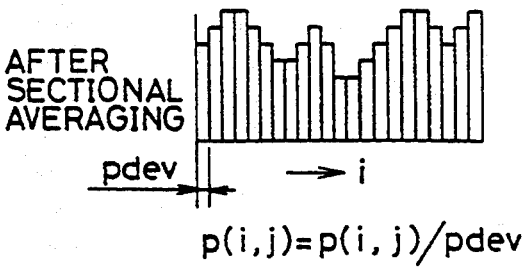
Figure 4D:
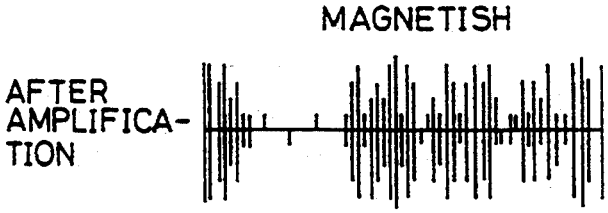
Figure 4E:
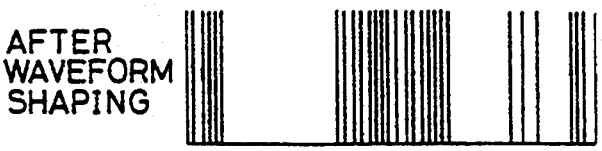
Figure 4F:
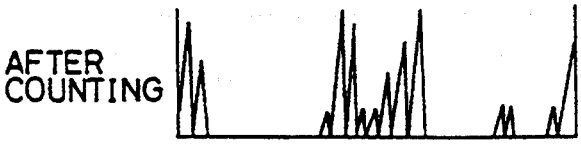
Figure 4G:
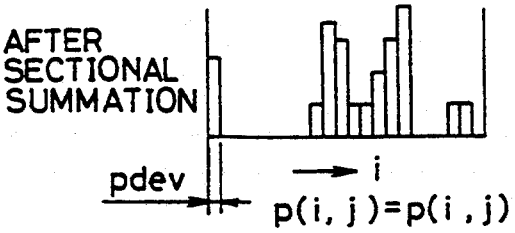

The CPU 31 initializes the value of the sensor selection index j in Step c1, and determines in Step c2 whether or not the value of the index j is greater than the maximum value jmax. If the value of the index j is not greater than the maximum value jmax, the CPU 31 proceeds to Step c3, whereupon it determines whether or not the current value of the index j is not greater than 3, that is, whether or not the index j indicates a value corresponding to one of the optical sensors. If it is concluded that the current value of the index j is not greater than 3 and is indicative of one optical sensor, the CPU 31 proceeds to Step c4, whereupon it reads an integrated value stored in the array register p(i, j) corresponding to the section name i and sensor name j, and divides the integrated value by the set value pdev, thereby obtaining an average value equivalent to one detection timing for the sensor Pj in the data detection region corresponding to the section name i. The CPU 31 stores the array register p(i, j) for renewal with this average value as detected data for the optical sensor Pj in the section i (see FIG. 4c). If it is concluded that the current value of the index j is not smaller than 4 and is indicative of one of the magnetic sensors, the process of Step c4 is not executed, and the integrated value stored in the array register p(i, j) is maintained as it is as detected data for the magnetic sensor Pj in the section i (see FIG. 4g).

Subsequently, in Step c5, the CPU 31 increments the value of the sensor selection index j, and then returns to the process of Step c2. Thereafter, the CPU 31 repeatedly executes the processes of Steps c2 to c5 in the same manner as described until the value of the index j exceeds jmax, and stores the array register p(i, j) with the detected data for each sensor Pj in the section i. The detected data in the register p(i, j) corresponds to each value pi in equation (2). In the present embodiment, the integrated value in the register p(i, j) is divided by pdev only if the index j corresponds to the value indicative of the optical sensor, and stores the register p(i, j) again with the resulting value as the detected data. Since the pdev number of cycles of detection in one section itself is helpful in leveling the data, the integrated value p(i, j) need not always be divided by pdev to obtain the average value. As in the case of the magnetic data, the integrated value p(i, j) itself can be used as the detected data by only properly setting set values for computations, decisions, etc.

Figure 9:
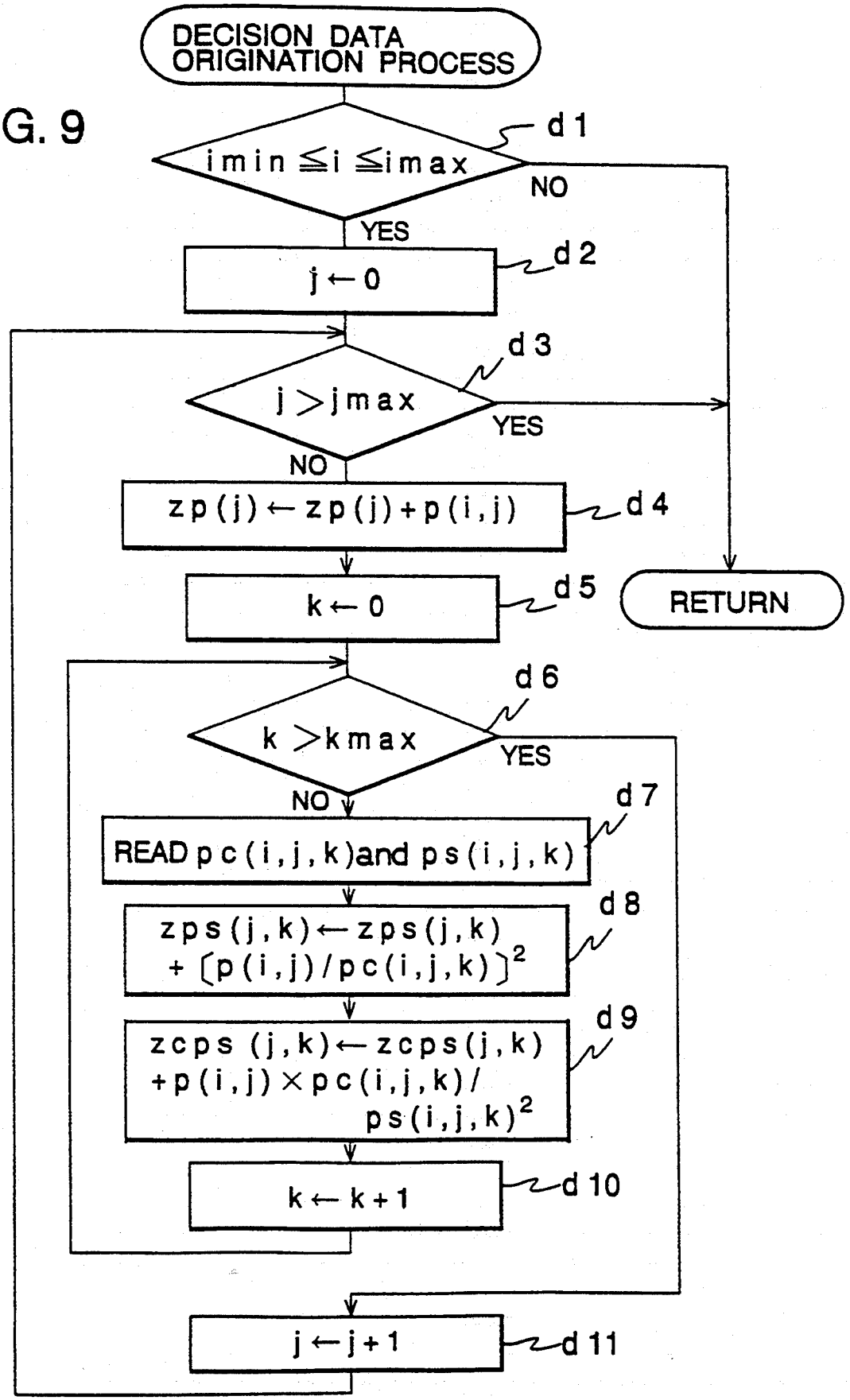
FIG. 9 is a flow chart showing a decision data origination process.
Figure 10:
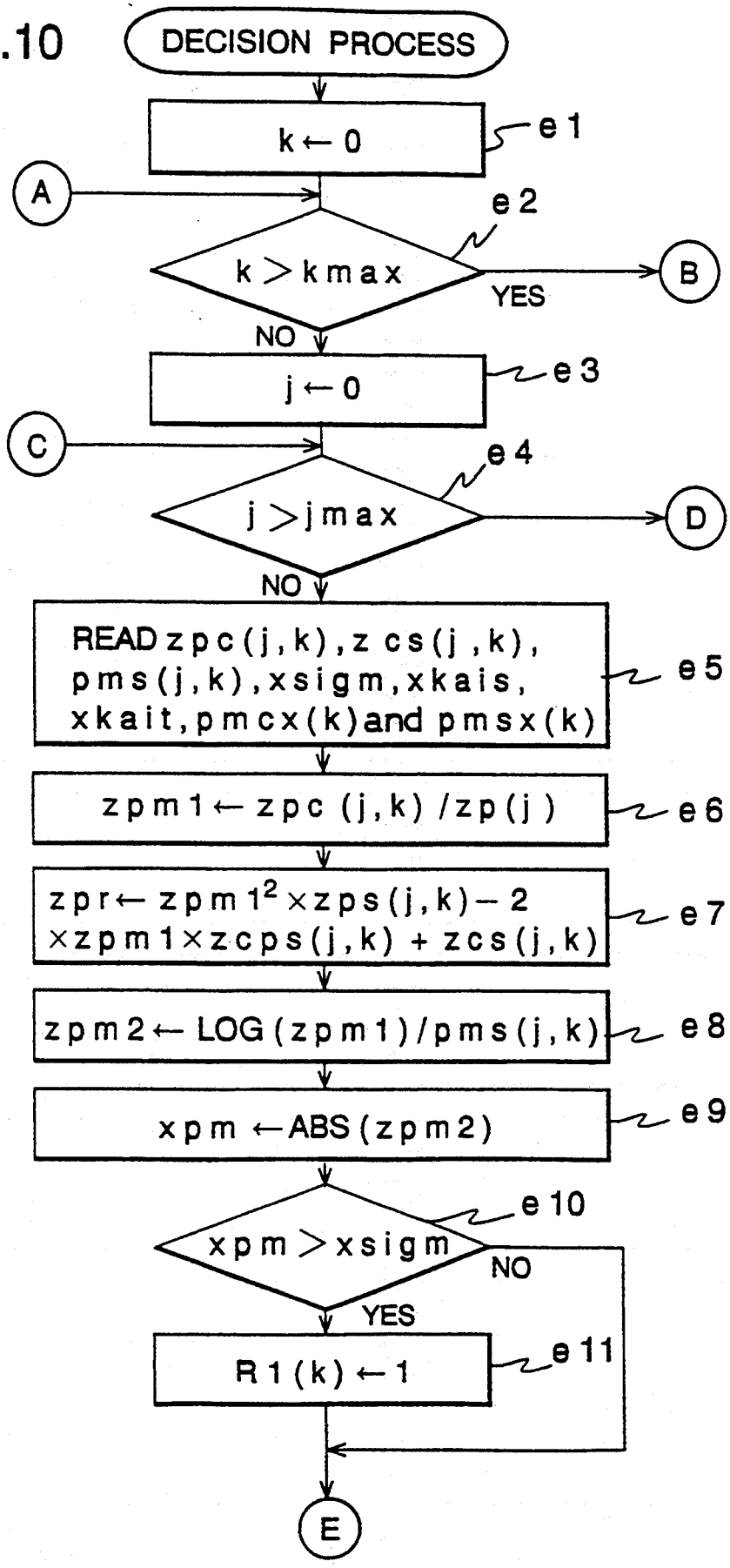
FIG. 10 is a flow chart showing a decision process.
Figure 11:
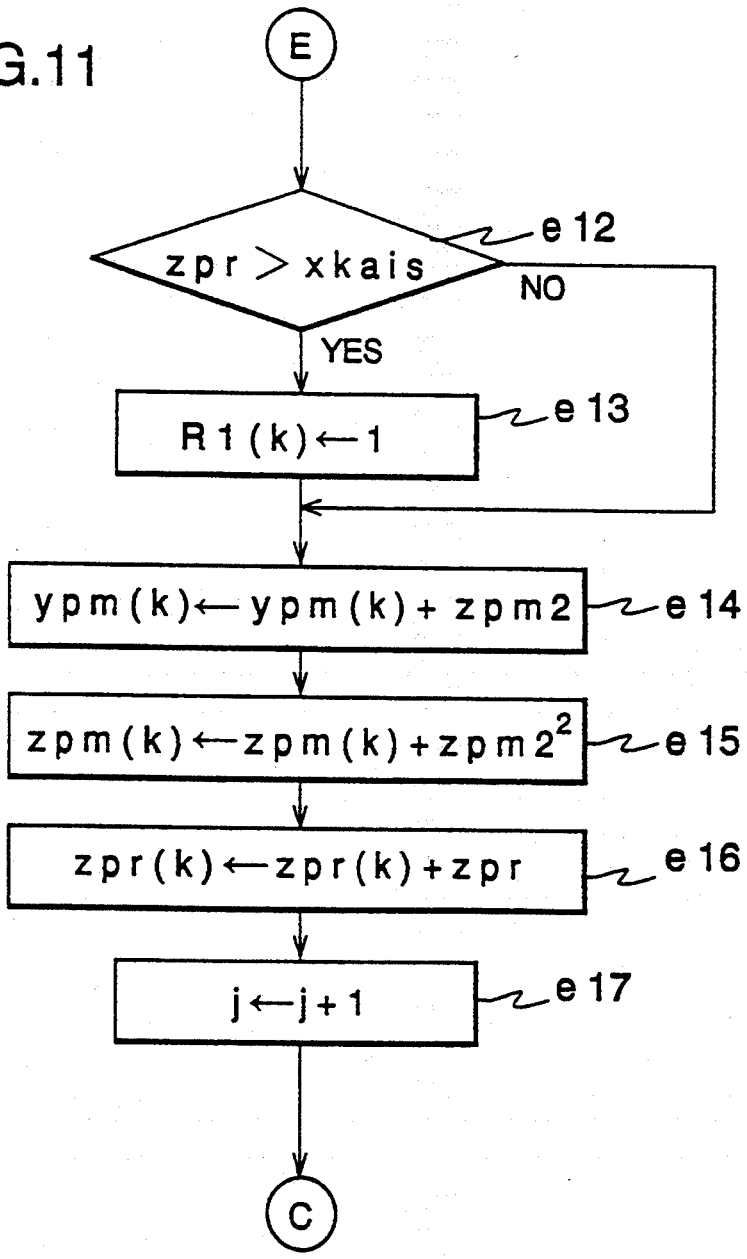
FIGS. 11 to 13 are continuations of the flow chart of FIG. 10.
Figure 12:
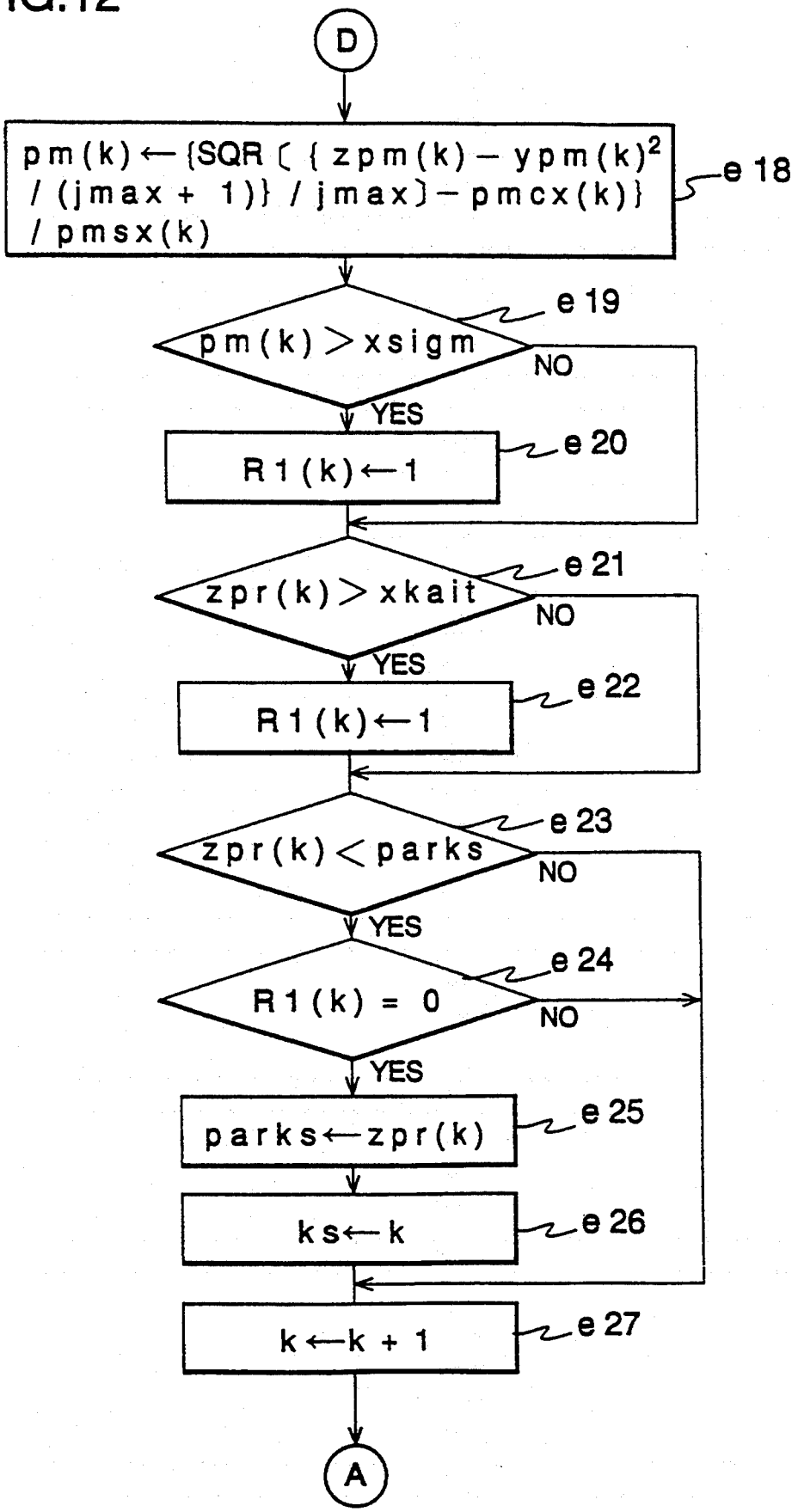
Figure 13:
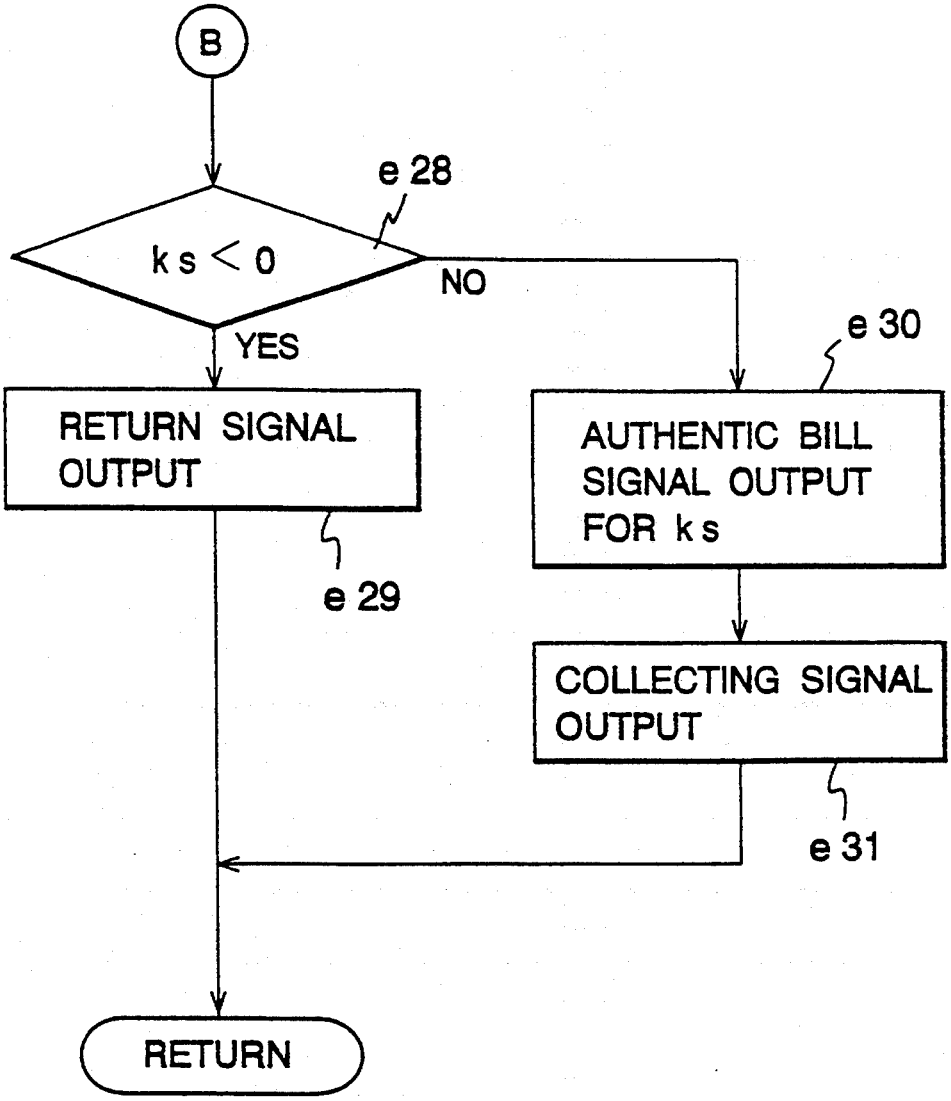

If it is concluded in the discrimination process of Step c2 that jmax is exceeded by the value of the sensor selection index j or that the storage of the detected data for each sensor in the section i is completed, the CPU 31 finishes the data compression process, and then executes the decision data origination process of Step b10, the principal part of which is shown in FIG. 9.

In the decision data origination process, the CPU 31 first determines whether or not the current value of the index i indicative of the section name is between set values imin and imax, that is, whether or not an i'th section of the data detection region, indicated by the current value of the index i, is within a range such that it is regarded as an appropriate object of data detection for the authentication and classification of the bill (Step d1). The process of Step d1 is a kind of filter means for improving the reliability of the data. Since nmax (=259) divided by pdev (=8) gives 32 with remainder 3, in the case of the present embodiment, the value i can range from 0 to 31 or 0 to 32. In general, the surface of a bill is liable to be soiled or damaged badly at its end portions. In the present embodiment, therefore, imin=2 and imax=28 are given, and data detected in the first two sections and the last five or six sections are neglected, and are not used detected data for decision. Thus, if the decision in Step d1 is negative, the processes of Steps d2 to d11, which are required for decision data origination, are not executed, and the CPU 31 proceeds to the process of Step b11 immediately after finishing the discrimination process of Step d1.

On the other hand, if the decision in Step d1 is positive, that is, if it is concluded that the data detected in the section i concerned is available for the authentication and classification, the CPU 31 continues to execute the process of Step d2 and the subsequent processes. In this case, the CPU 31 first initializes the value of the sensor selection index j in Step d2, and then determines in Step d3 whether or not the value of the index j is greater than the maximum value jmax. If the value of the index j is not greater than jmax, the CPU 31 proceeds to Step d4, whereupon it adds the value of the detected data from the sensors Pj, the current value in the array register p(i, j), to a value in a sensor-classified detected data integrating register zp(j) for integrating the detected data for all the detection sections (i=imin to imax) for the individual sensors Pj, thereby storing the register zp(j) with the integrated value of the detected data from the sensors Pj for the range from a section imin to the section i. Each integrating register zp(j) is a register which is initialized in the aforementioned process of Step a2, and its initial value is 0. The process of Step d4 is a process which corresponds to Σpi of equation (2), and the value Σpi is the final value of the register zp(j).

Subsequently, the CPU 31 sets an index k for specifying the types of the bills at the initial value 0 in Step d5, and determines in Step d6 whether or not the current value of the index k is greater than a set value kmax which corresponds to the number of types of the bills to be handled in the bill identification apparatus. If the value of the index k is not greater than the set value kmax, the CPU 31 proceeds to Step d7, whereupon it reads the respective values of standard data pc(i, j, k) and standard deviation ps(i, j, k) thereof from the nonvolatile RAM of the memory 32. The standard data pc(i, j, k) is the average of data obtained from the detection section i by testing a number of authentic bills of the type k by means of the sensors Pj. The standard deviation ps(i, j, k) is indicative of scattering of the data obtained from the detection section. Then, the CPU 31 executes an operational expression $[p(i, j)/ps(i, j, k)]^2$ in Step d8, on the basis of the value of the data p(i, j) detected from the detection sections i of the currently deposited bill by means of the sensors Pj and the value Ds(i, j, k), and integratively stores an integrating register zps(j, k) with the resulting value. Then, in Step d9, the CPU 31 executes an operational expression $p(i, j).pc(i, j, k)/ps(i, j, k)^2$ on the basis of the value of the detected data p(i, j) and the values of the standard data pc(i, j, k) and the standard deviation ps(i, j, k) thereof, and integratively stores an integrating register zcps(j, k) with the resulting value. Each of the registers zps(j, k) and zcps(j, k) is initialized in the aforementioned process of Step a2, and its initial value is 0. The processes of Steps d8 and d9 are processes for obtaining values corresponding to the terms $\Sigma(pi/psi)^2$ and $\Sigma\{(pi.pci)/psi^2\}$ of equation (4), respectively. $\Sigma(pi/psi)^2$ and $\Sigma\{(pi.pci)/psi^2\}$ of equation (4) are the final values of the registers zps(j, k) and zcps(j, k), respectively.

Subsequently, the CPU 31 increments the value of the index k for specifying the bill type in Step d10. Thereafter, the CPU 31 repeatedly executes the processes of Steps d8 to d10 in the same manner as described until the value of the index k exceeds the value kmax for the number of types of the bills to be handled in the bill identification apparatus. Then, using the average value pc(i, j, k) of the standard data for each bill type k and the value of the standard deviation ps(i, j, k) of the standard data in the detection section i, for the sensor Pj specified by the current value of the index j, the CPU 31 computes $zps(j, k)=\Sigma(pi/psi)^2$ and $zcps(j, k)=\Sigma\{(pi.pci)/psi^2\}$ for the sensors Pj in the range from the section imin to the section i, and stores the integrating register with the resulting value for renewal.

If it is concluded in the process of Step d6 that the value of the index k is greater than the bill type number kmax or that the integral data $\Sigma(pi/psi)^2$ and $\Sigma\{(pi.pci)/psi^2\}$, computed for the sensor Pj specified by the current value of the index j, in accordance with the standard data for each bill type, are stored for renewal, the CPU 31 proceeds to Step d11, whereupon it increments the value of the sensor selection index j for specifying the sensor. Thereafter, the CPU 31 repeatedly executes the processes of Steps d3 to d11 in the same manner as described until the value of the index j exceeds jmax. Thus, the CPU 31 obtains an integrated value zp(j)=Σpi of sensor-classified detected data for the individual sensors Pj, obtains $zps(j, k)=\Sigma(pi/psi)^2$ and $zcps(j, k)=\Sigma\{(pi.pci)/psi^2\}$ for sensors Pj in the range from the section imin to the section i, in accordance with the standard data for each bill type, and stores each integrating register with the-resulting values for renewal. If it is then concluded in the discrimination process of Step d3 that the value of the index j for specifying the sensor is greater than the set maximum value jmax corresponding to the number of sensors and the like or that the integration of various data for all the combinations of the sensors Pj of the bill identification apparatus and the bill types is finished, the CPU 31 finishes the decision data origination process and proceeds to Step b11.

In the process of Step b11, the CPU 31 increments the value in the counter n, and executes again the data fetch process shown in FIG. 7 from the beginning, in response to the next rotation detection signal from the pulse coder PC. This data fetch process is repeatedly executed every time the rotation detection signal from the pulse coder PC is inputted before nmax is exceeded by the value in the counter n.

If it is concluded in the discrimination process of Step b1 that the set value nmax for bill deposition is exceeded by the value in .the counter n as the data fetch process is repeatedly executed or that the bills are delivered to a discrimination position (where it is determined whether the bills should be deposited or returned after bill data detection), the CPU 31 proceeds to Step at, whereupon it stops the drive of the motor M to suspend the transportation of the bills. Then, the CPU 31 proceeds to the discrimination process of Step a6, the principal part of which is shown in FIGS. 10 to 13.

When the discrimination process is started, the CPU 31 first sets the index k for specifying the types of the bills at the initial value 0 in Step e1, and determines in Step d8 whether or not the current value of the index k is greater than the set value kmax which corresponds to the number of types of the bills to be handled in the bill identification apparatus. If the value of the index k is not greater than the set value kmax, the CPU 31 then executes a process for determining the authenticity and type of the bills on the basis of the standard data for each bill type k and sensor type j.

Thereupon, the CPU 31 initializes the sensor selection index j in Step e3, and then determines in Step e4 whether or not the value of the index j is greater than the maximum value jmax. If the value of the index j is not greater than jmax, the CPU proceeds to Step e5, whereupon it reads and temporarily stores the following data from the data previously stored in the nonvolatile RAM of the memory (i) a standard data integrated value zpc(j, k) as the average of integrated values of detected data obtained from the range from imin to imax by testing a number of authentic bills of the type k by means of the sensors Pj, that is, a value corresponding to Σpci of equation (ii) a standard deviation integrated value zcs(j, k) for standard data obtained by integrating, throughout the range from imin to imax, the squares of the standard data (pci of equations (2) and (4)), as the average of the detected data for each section, divided by the standard deviation (value corresponding to psi of equations (3) and (4)) of the corresponding standard data, that is, a value corresponding to $\Sigma(pci/psi)^2$ of equation (4);

(iii) a correction factor standard deviation pms(j, k) (value corresponding to pmsj of equation (5)) as the standard deviation of the respective correction factors of the sensors Pj, obtained by testing a number of authentic bills of the type k by means of the sensors Pj;

(iv) a correction factor scattering criterion value xsigm previously set for decision as to whether or not to permit scattering of the correction factors of the sensors Pj;

(v) a heterogeneity criterion value xkais previously set for decision as to whether or not to permit heterogeneity;

(vi) an overall heterogeneity criterion value xkai previously set for decision as to whether or not to permit overall heterogeneity computed by synthetically evaluating heterogeneities for the sensors Pj;

(vii) an average value pmcx(k) for standard data indicative of the scattering of the respective correction factors of the sensors Pj obtained by testing a number of authentic bills of the type k (value corresponding to pmcx of equation (6)); and (viii) a standard deviation value pmsx(k) (value corresponding to pmcx and pmsx of equation (6)).

Subsequently, in Step e6, the CPU 31 obtains the correction factors of the sensors Pj for the bill type k by dividing the value of the standard data integrated value zpc(j, k) by the value in the sensor-classified detected data integrating register zp(j), obtained by integrating the detected data from the sensors Pj throughout the range from imin to imax, and stores a correction factor storage register zpm1 with the resulting value. The process of Step e6 is an arithmetic process corresponding to equation (2). Then, the CPU 31 executes an operational expression corresponding to equation (4) in Step e7. More specifically, the CPU 31 executes the operational expression on the basis of the value in the correction factor storage register zpm1 corresponding to Σpci/Σpi, which is obtained in Step e6, the value in the integrating register zps(j, k) corresponding to $\Sigma(pi/psi)^2$ which is obtained in the process of Step d8, the value in the integrating register zcps(j, k) corresponding to $\Sigma\{(pi-pci)/psi^2\}$, which is obtained in the process of Step d9, and the standard deviation integrated value zcs(j, k) for standard data corresponding to $\Sigma(pi/psi)^2$, which is read in Step e5. Thus, the CPU 31 obtains the heterogeneity pr of each sensor Pj for the bill type k, and stores a heterogeneity storage register zpr with this value. Then, in Step e8, the CPU 31 executes an operational expression corresponding to equation (5) by taking a logarithm of the correction factor zpm1 of each sensor Pj for the bill type k and dividing the logarithm by the correction factor standard deviation pms(j, k) of the sensor Pj for the bill type k. Thus, the CPU 31 obtains a standardized correction factor by converting the correction factor zpm1 into normal distribution, and stores a storage register zpm2 with the obtained correction factor. In Step e9, moreover, the CPU 31 takes the absolute value of zpm2 for comparison, and temporarily stores a register xpm with it.

Subsequently, in Step e10, the CPU 31 determines whether or not the absolute value xpm of the standardized correction factor zpm2 is greater than the correction factor scattering criterion value xsigm, that is, whether or not to conclude that the deposited bill is not of the type k in accordance with the standardized correction factor based on the detected data obtained from the currently deposited bill by means of the sensors Pj. If it is concluded that the absolute value of the standardized correction factor zpm2 is greater than the correction factor scattering criterion value xsigm or that the bill is not of the type k, the CPU 31 proceeds to Step e11, whereupon it sets 1 in a rejection condition register R1(k) for recording that the deposited bill is not of the type k, and records that the lately deposited bill is not of the type k. If it is concluded that the absolute value of the standardized correction factor zpm2 is smaller than the correction factor scattering criterion value xsigm, the current value in the register R1(k) is retained as it is. Each rejection condition register R1(k) is initialized in the aforementioned process of Step a2, and its initial value is 0.

In Step e12, moreover, the CPU 31 determines whether or not the value of the heterogeneity (zpr) obtained in Step e7 is greater than the heterogeneity criterion value xkais, that is, whether or not to conclude that the deposited bill is not of the type k in accordance with the heterogeneity based on the detected data obtained from the currently deposited bill by means of the sensors Pj. If it is concluded that the value of the heterogeneity zpr is greater than the heterogeneity criterion value xkais or that the bill is not of the type k, the CPU 31 proceeds to Step e13, whereupon it sets 1 in the rejection condition register R1(k) for recording that the deposited bill is not of the type k, and records that the lately deposited bill is not of the type k. If it is concluded that the value of the heterogeneity zpr is smaller than the heterogeneity criterion value xkais, the current value in the register R1(k) is retained as it is.

Then, in Step e14, the CPU 31 integratively stores a linear correction factor function integrating register ypm(k) for each bill type k with the value of the standardized correction factor zpm2 obtained in the process of Step e8. In Step e15, moreover, the CPU 31 integratively stores a quadratic correction factor function integrating register zpm(k) for each bill type k with the square of the standardized correction factor zpm2. Each of the linear and quadratic correction factor function integrating registers ypm(k) and zpm(k) is initialized in the aforementioned process of Step a2, and its initial value is 0. The process of Step e14 is a process for integrating values of the standardized correction factor zpm2 corresponding to zpmj of equations (5) and (8), thereby obtaining a value corresponding to Σzpmj of equation (8). Σzpmj of equation (8) is the final value of the register ypm(k). The process of Step e15 is a process for integrating values $zpm2^2$ corresponding to $zpmj^2$ of equation (6), thereby obtaining a value corresponding to $\Sigma zpmj^2$ of equation (8). $\Sigma zpmj^2$ of equation (8) is the final value of the register zpm(k).

Subsequently, in Step e16, the CPU 31 integratively stores an overall heterogeneity storage register zpr(k) for each bill type k with the value of the heterogeneity (zpr) obtained in the process of Step e7. In Step e17, moreover, the CPU 31 increments the value of the sensor selection index j, and then returns to the process of Step e4. Each overall heterogeneity storage register zpr(k) is initialized in the aforementioned process of Step a2, and its initial value is 0.

Thereafter, the CPU 31 repeatedly executes the processes of Steps e4 to e17 in the same manner as described until the value of the sensor selection index j exceeds the maximum value jmax. Then, the CPU 31 determines whether or not it is appropriate to recognize that the currently deposited bill, as an object of decision, is of the type specified by the index k, in accordance with the criterion data previously stored in the nonvolatile RAM of the memory 32, corresponding to the combination of the bill type indicated by the index k and each sensor Pj. The criterion data include the standard data integrated value zpc(j, k), standard deviation integrated value zcs(j, k) for standard data, correction factor standard deviation pms(j, k), correction factor scattering criterion value xsigm common to individual combinations, and heterogeneity criterion value xkais. Thus, if there is any sensor which has detected data conformable to any of the aforesaid rejection conditions (Steps e10 and e12) for the bills of the type k as objects of comparison, 1 is set in the rejection condition register R1(k) corresponding to the bill type k. When the value of the index j reaches jmax as these processes are repeatedly executed, the values corresponding to Σzpmj and $\Sigma zpmj^2$ of equation (6) is loaded into the registers ypm(k) and zpm(k), respectively, in the finally executed processes of Steps e14 and e15. Moreover, the register zpr(k) is loaded with the overall heterogeneity as an integrated value of the heterogeneities computed according to the data obtained from the individual sensors Pj (Step e16), and the value of the sensor selection index j is inched to jmax+i (Step e17).

When jmax is exceeded by the value of the index j, the CPU 31 detects this in the discrimination process of Step e4, and then proceeds to the process of Step e18. In Step e18, the CPU 31 executes an operational expression corresponding to equation (8) on the basis of the values in the registers ypm(k) and zpm(k), which correspond to Σzpmj and $\Sigma zpmj^2$ of equation (8), respectively, and the set values pmcx(k) and pmsx(k) corresponding to pmcx and pmsx of equation (6), respectively, and read in Step e5, thereby computing a value indicative of scattering of the correction factor of each sensor on the assumption that the deposited bill as the object of decision is of the type k. The computed value is loaded into a scattering value storage register pm(k) for each bill type k. In this case, jmax +1=6 and jmax=5 are given.

Then, in Step e19, the CPU 31 determines whether or not the value in the register pm(k) is greater than the correction factor scattering criterion value xsigm, that is, whether or not the assumption that the deposited bill is of the type k is appropriate. If it is concluded that the value in the register pm(k) is greater than the criterion value xsigm or that the assumption that the deposited bill is of the type k is wrong, the CPU 31 proceeds to Step e20, whereupon it sets 1 in the rejection condition register R1(k) for recording that the deposited bill is not of the type k. If it is concluded that the value in the register pm(k) is smaller than the criterion value xsigm, the current value in the register R1(k) is retained as it is. In Step e21, moreover, the CPU 31 determines whether or not the value of the overall heterogeneity zpr(k) is greater than the overall heterogeneity criterion value xkait, that is, whether or not it is appropriate to recognize that the deposited bill is of the type k. If it is concluded that the value of the overall heterogeneity zpr(k) is greater than xkait or that it is inappropriate to recognize that the deposited bill is of the type k, the CPU 31 proceeds to Step e22, whereupon it sets 1 in the rejection condition register R1(k). If it is concluded that the value zpr(k) is smaller than xkait, the current value in the register R1(k) is retained as it is.

Subsequently, in Step e23, the CPU 31 determines whether or not the lately computed value of the overall heterogeneity zpr(k) is smaller than a current value in a minimum heterogeneity storage register parks. The register parks is initialized in the aforementioned process of Step e2, and its initial value is positive infinity (maximum settable value). If it is concluded that the lately computed value of the overall heterogeneity zpr(k) is smaller than the current value in the register parks, the CPU 31 proceeds to Step e24, whereupon it determines whether or not 0 is set in the rejection condition register R1(k), that is, whether or not it has already been concluded that it is appropriate to recognize that the currently deposited bill is of the type k. If the decision is positive, the CPU 31 stores the register parks for renewal with the lately computed value of the overall heterogeneity zpr(k) as a minimum overall heterogeneity value in Step e25. In Step e26, moreover, the CPU 31 stores an authentic bill type candidate storage register ks with the bill type k for renewal. The register ks is initialized in the aforementioned process of Step a2, and its initial value is negative infinity (at least smaller than zero). On the other hand, if the decision in Step e23 or e24 is negative, that is, if it is concluded that the lately computed value of the overall heterogeneity zpr(k) is greater than the current value in the register parks, the processes of Steps e25 and e26 are not executed, and the CPU 31 retains the current values in the minimum heterogeneity storage register parks and the authentic bill type candidate storage register ks as they are. This is also done when it has already been concluded that it is inappropriate to recognize that the currently deposited bill is of the type k, even though it is concluded that the lately computed value of the overall heterogeneity zpr(k) is smaller than the current value in the register parks.

Subsequently, the CPU 31 increments the value of the index k for specifying the bill type in Step e27, and then proceeds to the process of Step e2.

Thereafter, the CPU 31 repeatedly executes the processes of Steps e2 to e27 for the newly specified bill type k in the same manner as described until the value of the index k exceeds the set value kmax corresponding to the number of types of the bills to be handled in the bill identification apparatus. Thus, the CPU 31 stores the minimum heterogeneity storage register parks and the authentic bill type candidate storage register ks with the value of the overall heterogeneity zpr(k) and the bill type k, respectively, for renewal (Steps e25 and e26), provided that the overall heterogeneity zpr(k), obtained on the assumption that the currently deposited bill is of the type k, is smaller than the minimum heterogeneity value parks computed so far (or initialized) and that it is concluded that it is appropriate to recognize that the currently deposited bill is of the type k (Steps e23 and e24). In this manner, the register ks stores the value k corresponding to the bill type with which the value of the overall heterogeneity zpr(k), as compared with the currently deposited bill, is the smallest, among other bill types with which i is not set in their corresponding rejection condition registers R1(k).

When the value of the index k for specifying the bill type exceeds kmax as these processes are repeatedly executed, and if it is concluded in the discrimination process of Step e2 that the aforementioned processes have been executed for all the types k of the bills to be handled in the bill identification apparatus, the CPU 31 proceeds to the process of Step e28, whereupon it determines whether or not the value in the authentic bill type candidate storage register ks is smaller than 0. If the value in the register ks is smaller than 0, then it indicates that the decision in Step e24 has no opportunity at all to be positive, and that there is not any bill type indicated by the rejection condition register R1(k) which is not set to 1, that is, the currently deposited bill is false. Accordingly, the CPU 31 proceeds to Step e29, whereupon it outputs a return signal, and then proceeds to Step a7 to execute a return process for the bill. If the value in the authentic bill type candidate storage register ks is not smaller than 0, then it indicates that the register ks is stored with the value k corresponding to the bill type with which the value of the overall heterogeneity zpr(k), as compared with the currently deposited bill, is the smallest, among other bill types with which 1 is not set in their corresponding rejection condition registers R1(k). Accordingly, the CPU 31 proceeds to Step e30, whereupon it outputs an authentic bill signal corresponding to one of the bill types stored in the register ks. After outputting a bill collecting signal for collecting the bill in the bill identification apparatus in Step e31, the CPU 31 proceeds to Step a7, whereupon it executes a collecting process for the bill.

After finishing the operation for returning or collecting the bill in the process of Step a7, the CPU 31 returns to the initial standby state for the deposition of another bill (Step a1). Thereafter, the CPU S1 repeatedly executes the same processes as aforesaid every time the insertion of a bill is detected.

According to the bill identification apparatus of the present invention, the detected data pi are corrected by means of the correction value pm, and the authentication is effected by comparing the corrected detected data pm.pi and the standard pattern value pci. Thus, the authenticity of the bills can be discriminated without any fluctuations of the data attributable to general deterioration or soiling of the bills or detecting means.

Also, the authenticity and type of the bills are discriminated by computing the heterogeneity pr on the basis of a statistical synthetic evaluation of the correlation between the standard pattern value pci and the detected data pi for each detection position i. Even if the bills are subject partial soiling or the like, therefore, the decision cannot be substantially affected by partial data errors. Thus, the reliability of the authentication and classification of the bills can be further improved.

Furthermore, the data required for the computation of the correction value pm and the heterogeneity pr are gradually updated by means of correction value computing means and heterogeneity computing means every time the detecting means detects the characteristic data pi, so that the detected data pi need not be stored in large numbers in the memory, and a large number of stored data need not be processed en bloc. Thus, the memory capacity of the memory means can be saved, and the load on the arithmetic processing means, such as the correction value and heterogeneity computing means, can be reduced.

What is claimed is:

1. A bill identification apparatus comprising:

transportation means for transporting bills along a transportation path;

detecting means in the transportation path for sampling the bills in synchronism with the bill transportation speed, detecting the physical properties of the bills in each of detection positions i, and outputting detected data pi for the detected properties;

memory means for storing standard pattern values pci, indicative of average values for the individual detection positions i computed in accordance with the detected data pi obtained by sampling a number of authentic bills by said detecting means, and standard deviation values psi indicative of the degrees of scattering of data in the detection positions i;

correction value computing means for obtaining a correction value pm for making an average value of the detected data pi for a detection section, detected by sampling the bills to be identified by said detecting means, equal to an average value of the standard pattern value pci for the detection section;

heterogeneity computing means for obtaining a heterogeneity pr by correcting the detected data pi, detected by sampling the bills to be identified by said detecting means, using the correction value pm, then subtracting the corresponding standard pattern value pci from thus corrected detected data value pi, and integrating the square of the resulting remainder divided by the corresponding deviation value psi, for a detection frequency corresponding to the detection section; and discriminating means for concluding that a bill is authentic only when the correction value and the heterogeneity are within respective predetermined tolerances thereof.

2. A bill identification apparatus according to claim 1, wherein said detecting means comprises a plurality of detecting means Pj arranged in an offset manner in a direction perpendicular to the direction of transportation of the bills; said memory means stores average values, standard pattern values pcij, and deviation values psij for the individual detecting means Pj; said correction value computing means and said heterogeneity computing means obtain correction values pmj and heterogeneities prj, respectively, for the individual detecting means Pj; and said discriminating means concludes that bills are authentic only when all the correction values and the heterogeneities are within respective predetermined tolerances thereof.

3. A bill identification apparatus according to claim 1, wherein said memory means further stores the sum total Σpci of the standard pattern values pci for the detection section and the sum total $\Sigma(pci/psi)^2$ of the square of each standard pattern value pci divided by each corresponding standard deviation value psi for the detection section; said correction value computing means successively integrates the detected data pi delivered from the detecting means in the detection section, and obtains the correction value pm by dividing the sum total Σpci of the standard pattern values pci by the resulting integrated value Σpi when the detection section terminates; and said heterogeneity computing means successively obtains an integral $\Sigma(pi/psi)^2$ of the square of the detected data pi divided by the deviation value psi in the corresponding position and an integral $\Sigma(pi.pci/psi^2)$ of a value obtained by dividing the product of the detected data pi and the corresponding standard pattern value pci by the square of the deviation value psi, and obtains the heterogeneity pr by making a computation given as follows:

$$pr=pm^2.\Sigma(pi/psi)^2-2.pm.\Sigma(pi.pci/psi^2)+\Sigma(pci/psi)^2$$

when the detection section terminates.

4. A bill identification apparatus according to claim 3, wherein said detecting means comprises a plurality of detecting means Pj arranged in an offset manner in a direction perpendicular to the direction of transportation of the bills; said memory means stores average values, standard pattern values pcij, deviation values psij, sum total Σpcij of the standard pattern values pcij, and sum total $\Sigma(pcij/psij)^2$ of the square of each standard pattern value pcij divided by each corresponding standard deviation value psij for the detection section; said correction value computing means and said heterogeneity computing means obtain correction values pmj and heterogeneities prj, respectively, for the individual detecting means Pj; and said discriminating means concludes that bills are authentic only when all the correction values and the heterogeneities are within respective predetermined tolerances thereof.

5. A bill identification apparatus according to claim 2 or 4, which further comprises overall heterogeneity computing means for obtaining an overall heterogeneity Σprj by summing up the heterogeneities prj for the individual detecting means Pj, and wherein said discriminating means does not conclude that the bills are authentic when the overall heterogeneity Σprj is not within a predetermined tolerance thereof.

6. A bill identification apparatus according to claim 5, wherein said memory means stores data corresponding to types of bills, said correction value computing means, said heterogeneity computing means, and said overall heterogeneity computing means obtain the correction value, heterogeneity, and overall heterogeneity, respectively, for each bill type, and said discriminating means outputs authentic bill signals corresponding to the type of bill when the correction value, heterogeneity, and overall heterogeneity are all within respective predetermined tolerances thereof.

7. A bill identification apparatus according to claim 2 or 4, which further comprises correction value scattering detecting means for detecting the degrees of scattering of the correction values pmj of the individual detecting means Pj, and wherein said discriminating means concludes that the bills are authentic only when all the correction values, heterogeneities, and scattering degrees are within respective predetermined tolerances thereof.

8. A bill identification apparatus according to claim 7, which further comprises overall heterogeneity computing means for obtaining an overall heterogeneity Σprj by summing up the heterogeneities prj for the individual detecting means Pj, and wherein said discriminating means does not conclude that the bills are authentic when the overall heterogeneity Σprj is not within a predetermined tolerance thereof.

9. A bill identification apparatus according to claim 8, wherein said memory means stores data corresponding to types of bills, said correction value computing means, said heterogeneity computing means, said overall heterogeneity computing means, and said correction value scattering detecting means obtain the correction value, heterogeneity, overall heterogeneity, and correction value scattering degree, respectively, for each bill type, and said discriminating means outputs authentic bill signals corresponding to the type of bill when the correction value, heterogeneity, overall heterogeneity, correction value scattering degree are all within respective predetermined tolerance.

* * * * *